US005281165A

United States Patent [19]

McCleerey et al.

[11] Patent Number: 5,281,165

[45] Date of Patent: Jan. 25, 1994

[54] ELECTRICAL CONNECTOR SHROUD ADAPTED FOR SHORTING BAR REMOVAL

[75] Inventors: Earl W. McCleerey, Mechanicsburg; Michael A. McCaffrey, Harrisburg; Robert N. Whiteman, Jr., Middletown, all of Pa.

[73] Assignee: The Whitaker Corporation, Wilmington, Del.

[21] Appl. No.: 951,498

[22] Filed: Sep. 28, 1992

[51] Int. Cl.[5] ..... H01R 31/08

[52] U.S. Cl. ..... 439/510; 439/79; 439/189; 439/923

[58] Field of Search ..... 439/507-514, 439/189, 49, 923, 64, 79, 80, 377

[56] References Cited

U.S. PATENT DOCUMENTS

| | | | |
|---|---|---|---|
| 4,171,861 | 10/1979 | Hohorst | 439/49 |
| 4,795,602 | 1/1989 | Pretchel et al. | 439/510 |
| 4,859,191 | 8/1989 | Tonooka et al. | 439/79 |
| 5,129,831 | 7/1992 | Locati | 439/79 |
| 5,147,226 | 9/1992 | Kile | 439/680 |

FOREIGN PATENT DOCUMENTS

| | | | |
|---|---|---|---|
| 1109919 | 4/1968 | United Kingdom | 439/680 |

OTHER PUBLICATIONS

Berg PV Connector Systems; DuPont Inc.; Bulletin 1000, No. 1012-0, No. 1013.0, Sep. 1978.

Two-In-One Header-DuPont Electronics, Wilmington, Del., 19880, Oct. 1991.

Two-In-One Header—Electronic Connector News, DuPont Connector Systems, Wilmington, Del. 19880.

Disk Drive Connector—Electronic Connector News, C. W. Industries, Southampton, Penna. 18966.

*Primary Examiner*—Neil Abrams

[57] ABSTRACT

An electrical connector (1), comprising: an insulative housing (2), a shroud (3) to receive therein a shorting bar (25) at a selected one of multiple positions (29) interconnecting electrically at least two electrical contacts (5) selected from multiple contacts (5), each of the positions (29) of the shorting bar (25) being aligned with at least one of multiple openings (21) for said one of the openings (21) to provide an entryway for an extraction tool (30) to extract the shorting bar (25).

7 Claims, 7 Drawing Sheets

ELECTRICAL CONNECTOR SHROUD ADAPTED FOR SHORTING BAR REMOVAL

The invention relates to an electrical connector having a shroud at a mating end of the connector.

BACKGROUND OF THE INVENTION

A known electrical connector disclosed in U.S. Pat. No. 5,129,831, comprises; an insulative housing, a shroud at a mating end of the housing, and multiple electrical contacts within the shroud and projecting toward the mating end. The shroud protects the contacts and assists in aligning the known connector during connection with a complementary connector. Keying elements on both the known connector and the complementary connector allow connection of the connectors when the connectors are oriented with the keying elements aligned with one another.

SUMMARY OF THE INVENTION

The invention pertains to an electrical connector comprising, an insulative housing, and multiple electrical contacts to receive a shorting bar at a selected one of multiple positions interconnecting electrically at least two of the contacts. Multiple openings through the shroud allow for entry of an extraction tool to remove a shorting bar. Each of the multiple positions of the shorting bar is aligned with at least one of the openings. Each pair of contacts to be interconnected by the shorting bar is aligned with at least one of the openings.

DESCRIPTION OF THE DRAWINGS

An embodiment of the invention will now be described by way of example with reference to the drawings, in which.

DETAILED DESCRIPTION

Figure 1:
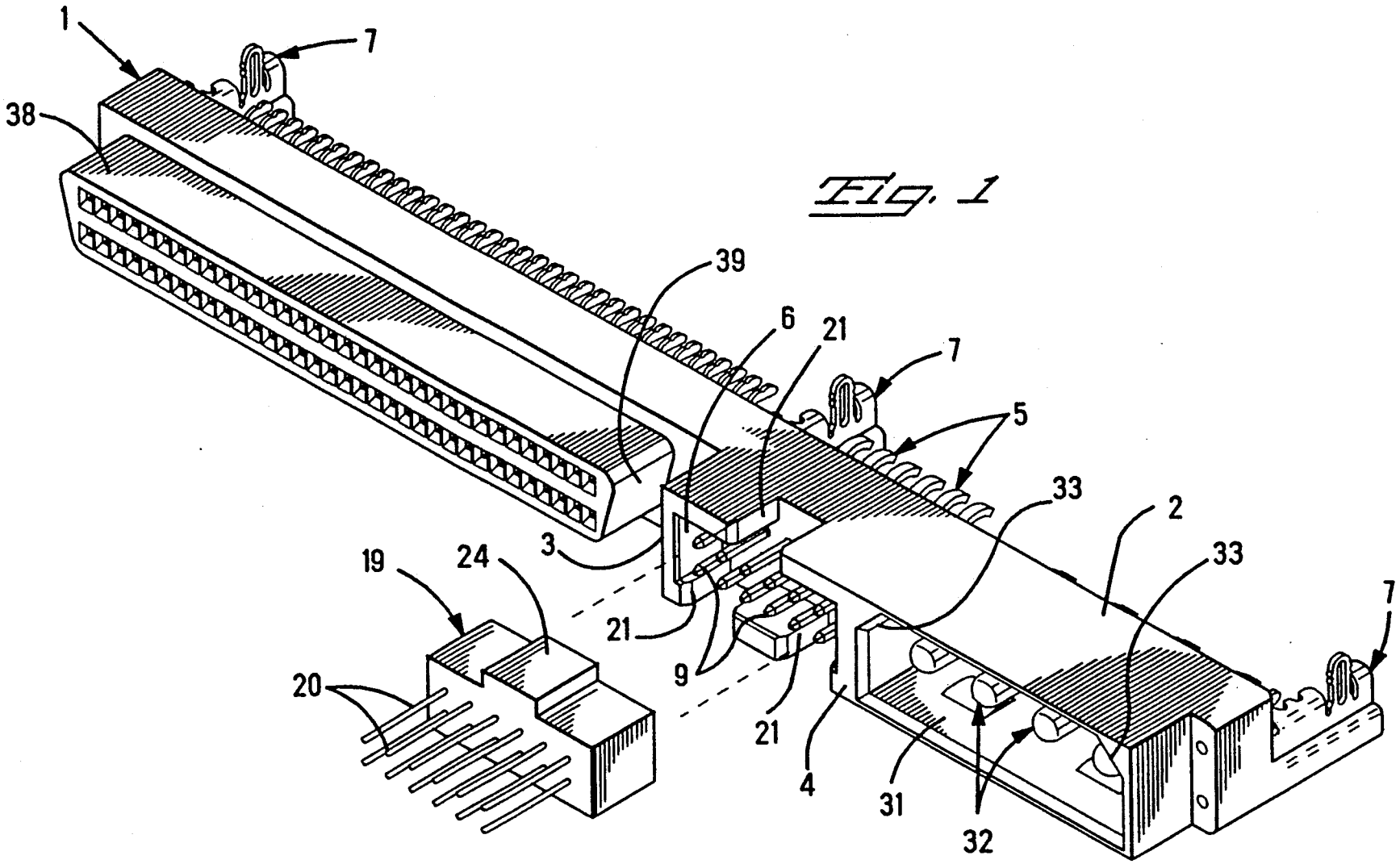
FIG. 1 is an isometric view of shrouded electrical connectors combined with an unshrouded electrical connector and a mating plug.
Figure 2:
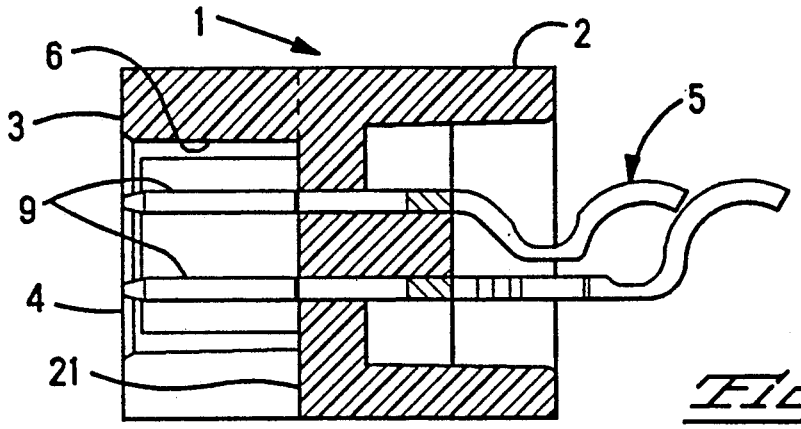
FIG. 2 is a section view taken along the line 2—2 of FIG. 6.
Figure 3:
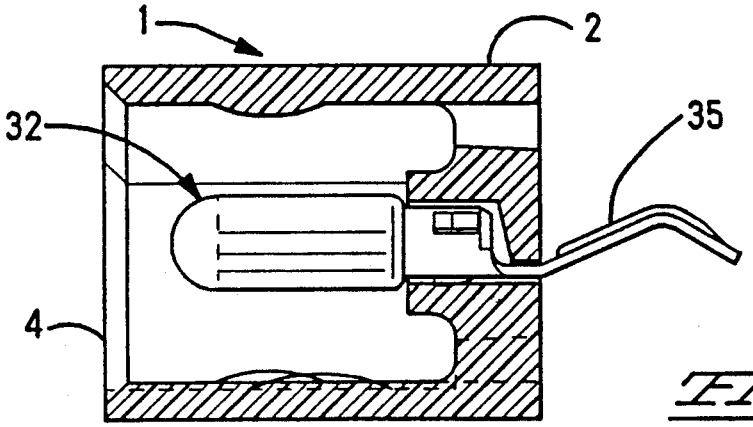
FIG. 3 is a section view taken along the line 3—3 of FIG. 6.
Figure 4:
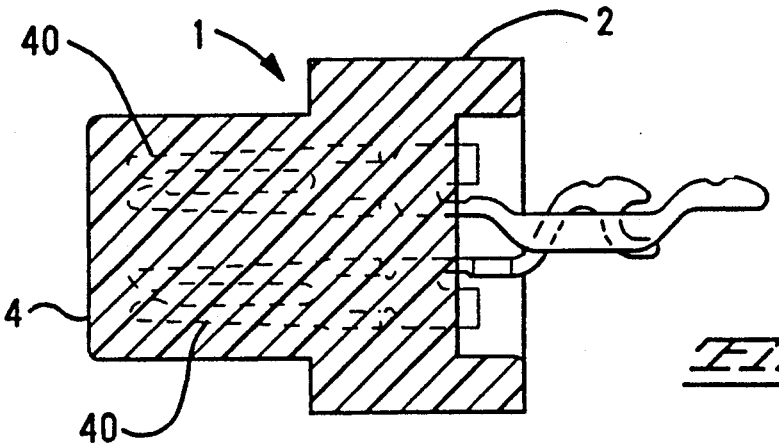
FIG. 4 is a section view taken along the line 4—4 of FIG. 6.
Figure 5:
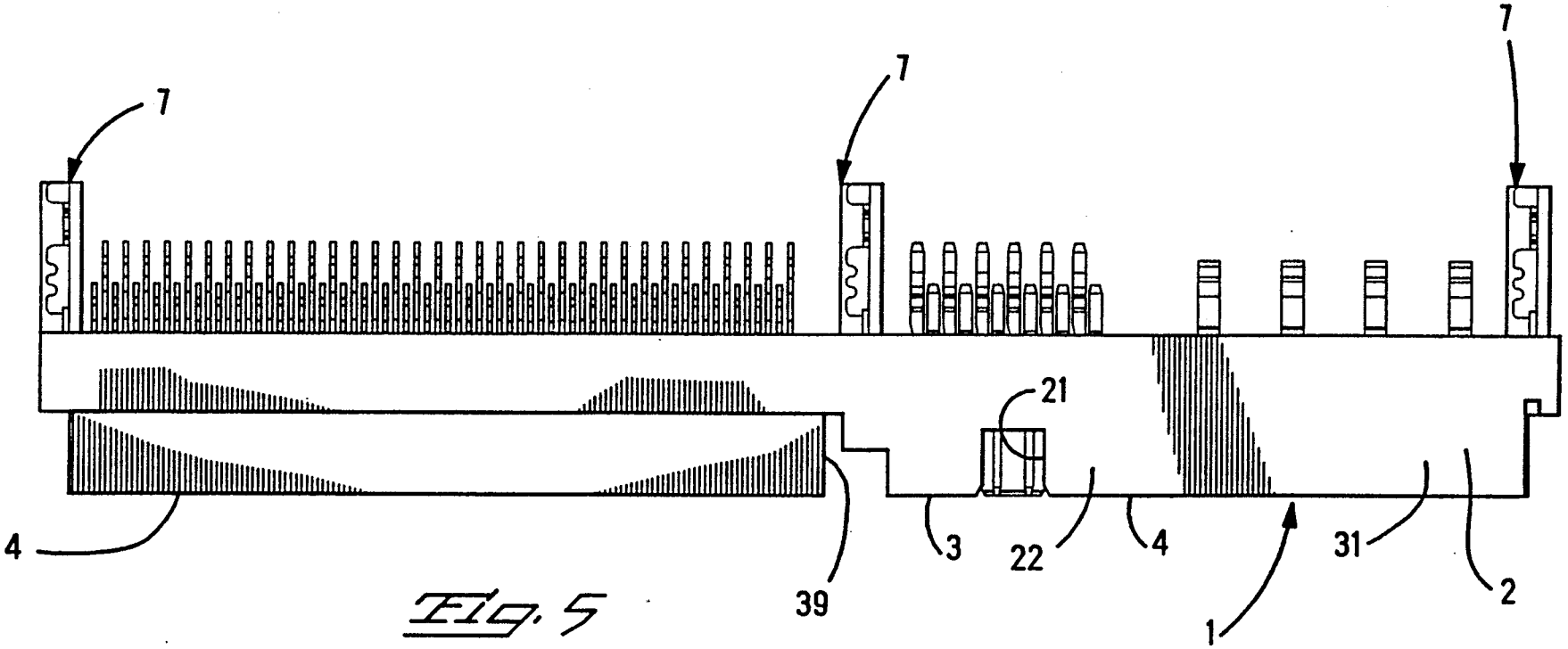
FIG. 5 is a top plan view of the connector shown in FIG. 1.
Figure 6:
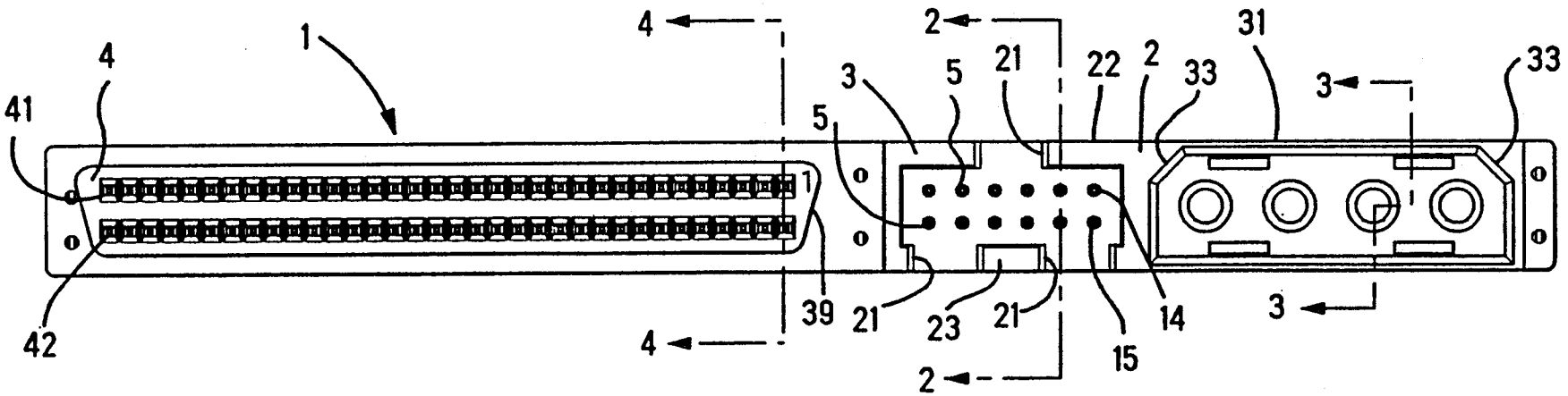
FIG. 6 is a front elevation view of the connector shown in FIG. 1.
Figure 7:
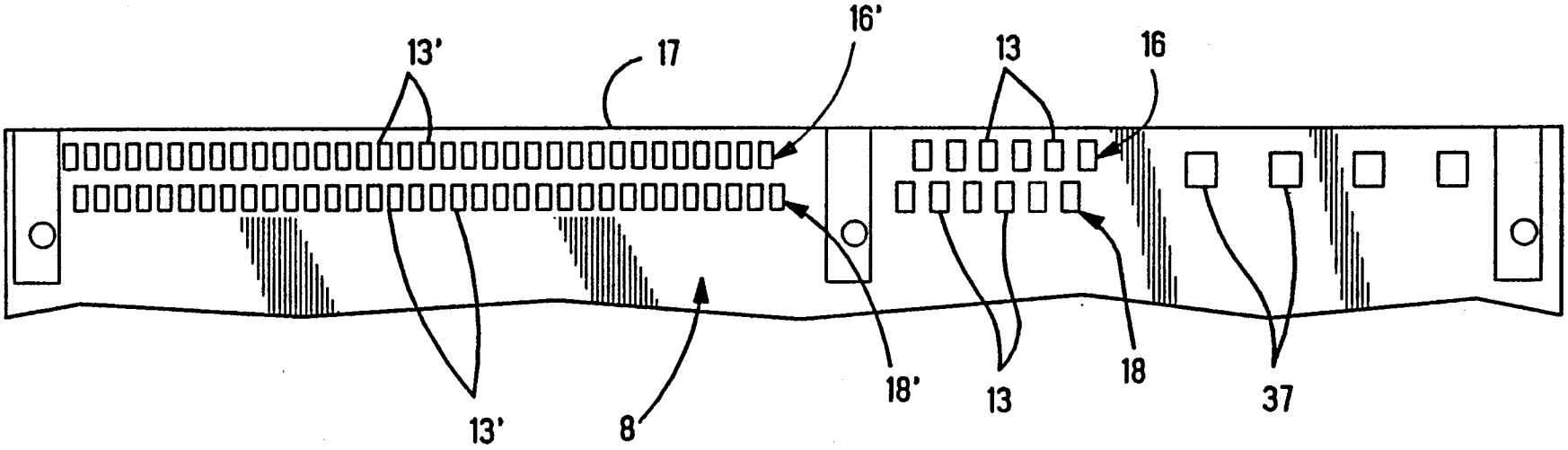
FIG. 7 is a fragmentary bottom plan view of a circuit board.
Figure 8:
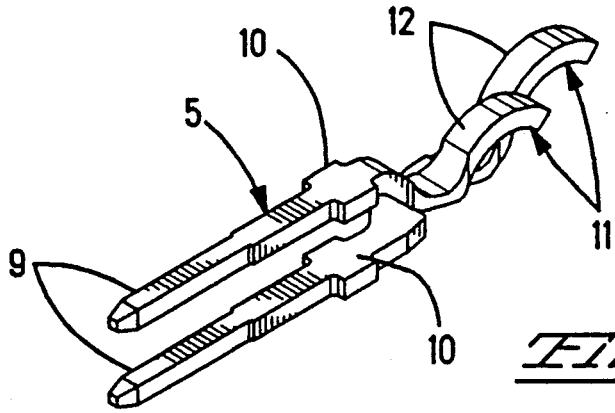
FIG. 8 is a perspective view of a pair of electrical contacts within a shroud of the connector shown in FIG. 1.

With reference to FIG. 1, an electrical connector 1 comprises, an insulative housing 2 of unitary molded plastic construction, a shroud 3 at a mating end 4 of the housing 2, and multiple electrical contacts 5, FIGS. 2 and 8, within the shroud 3 projecting toward the mating end 4. The contacts 5 are within a cavity 6 defined by the shroud 3. A board mount 7 on the housing 2 connects the housing 2 with a circuit board 8, FIG. 7.

With reference to FIG. 8, each of the contacts 5 is conductive, and will now be described. Each contact 5 is of unitary construction obtained by being stamped and formed from a strip, not shown, of conductive metal. Each contact 5 comprises, a front pin 9 of 0.5 mm square cross section, a wider stepped portion 10 and a rear solder terminal 11 with a contact surface 12 for connection to one of multiple conductive pads 13, FIG. 7, of the circuit board 8. The contact surface 12 is convex curved for establishing a surface mount connection with a conductive pad 13. Alternatively, the contact surface 12 can be on a solder terminal 11 shaped as a post, not shown, for establishing a connection in a plated through hole, not shown, of a circuit board, not shown.

In the cavity 6 of the shroud 3, the pins 9 of the multiple contacts 5 are arranged in two rows, a top row 14 and a bottom row 15. The pins 9 are on 2.0 mm. pitch spacing, meaning that the centerlines of the pins 9 are spaced apart 2.0 mm. Consequently, the centerlines of the two rows 14, 15 are spaced apart 2.0 mm. Each pin 9 of the top row 14 is directly aligned with a pin 9 in the bottom row 15.

The solder terminal 11 of each contact 5 projects from a rear of the housing 2. The solder terminals 11 of the contacts 5 in the bottom row 15 bend upward to engage a first row 16 of the pads 13 near an edge 17 of the circuit board 8. The solder terminals 11 of the contacts 5 in the bottom row 15, being longer than those of the contacts 5 in the top row 14, bend upward to engage a second row 18 of the pads 13 farther from the edge 17 of the circuit board 8.

The solder terminal 11 of each contact 5 in the top row 14 is offset laterally from the centerline of the pin 9 of the same contact 5. Thereby, a solder terminal 11 of each contact 5 in the bottom row 15 can bend upward without engaging a solder terminal 11 of a contact 5 in the top row 14. The solder terminals 11 of the contacts 5 in one of the rows 14, 15 are offset laterally with respect to the solder terminals 11 of the contacts 5 in the other of the rows 14, 15.

With reference to FIG. 1, an electrical plug 19 is a complementary connector adapted for mating connection with the connector 1. The periphery of the shroud 3 is shaped to interfit with the complementary shaped periphery of the plug 19. The shroud 3 assists in aligning the connector 1 during connection with the electrical plug 19. The plug 19 contains electrical contacts, not shown, for mating with the pins 9, such contacts being connected to respective electrical wires 20 terminated with the plug 19. Multiple openings 21 extend through respective sides 22, 23 of the shroud 3 beside one of the rows 14, 15 of the pins 9. The openings 21 are distributed about a periphery of the shroud 3. All of the openings 21 extend through the mating end 4 of the connector 1 and extend rearward from the mating end 4. One of the openings 21 is a keyway located along one side 22 of the shroud 3, and is shaped to interfit with a complementary shaped, projecting key 24 on the plug 19. The plug 19 will connect with the connector 1 only when the key 24 is aligned with the keyway, because no other side 23 of the shroud 3 has an opening 21 in a location which will be aligned with the key 24 when the plug 19 is attempted to be inserted into the shroud 3.

Figure 11:
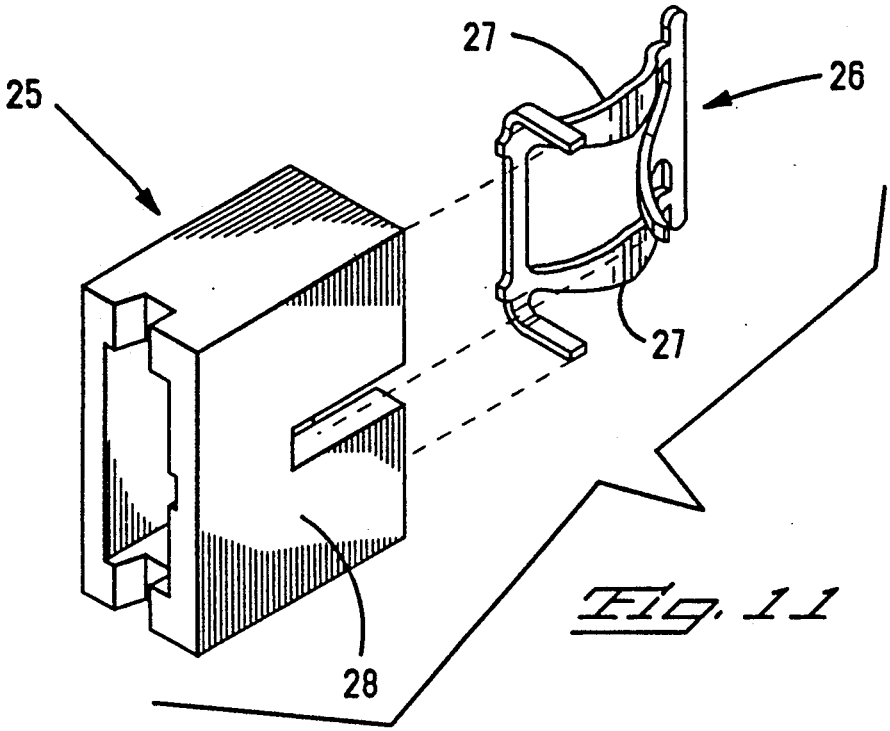
FIG. 11 is an isometric view of a shorting bar, with parts separated from one another.
Figure 12:
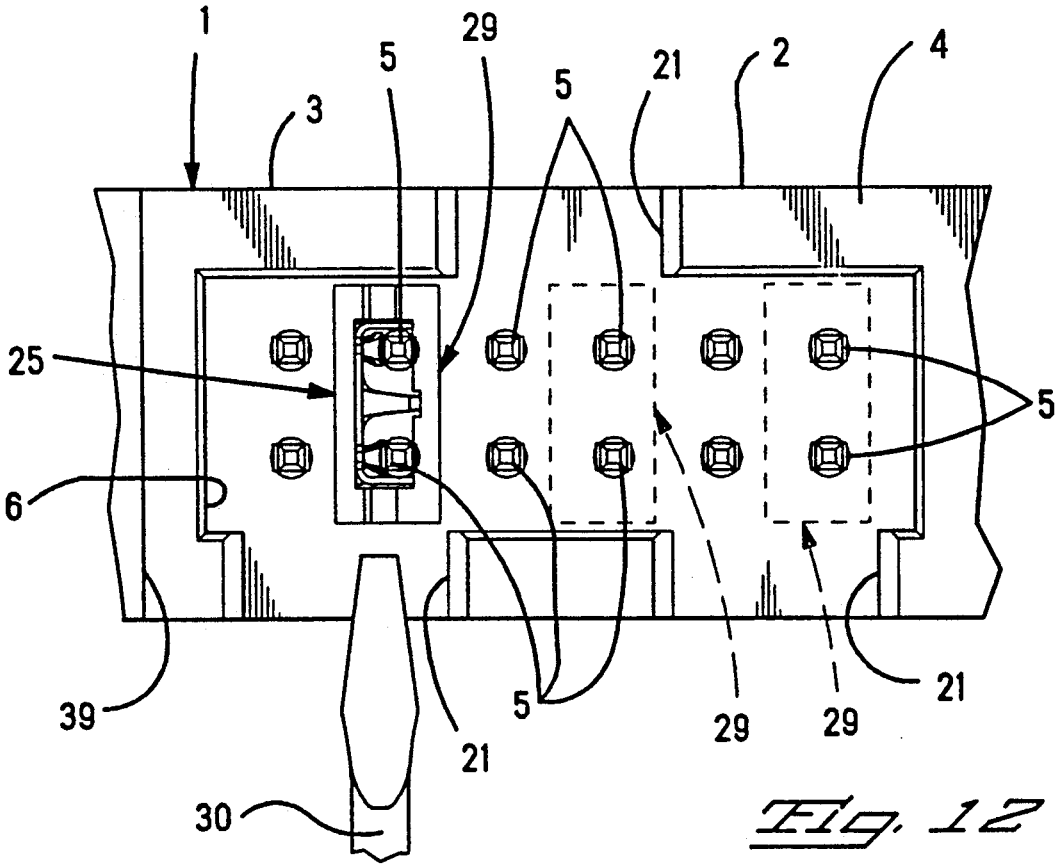
FIG. 12 is a fragmentary elevation view of a shorting bar in the connector shown in FIG. 1, and further illustrating, a number of alternative positions of the shorting bar.

With reference to FIGS. 11 and 12, a shorting bar 25 comprises, a conductive metal strip 26 with end spring fingers 27 within an insulative sheath 28, fabricated by insert molding. The shorting bar 25 is adapted to be inserted into the cavity 6 of the shroud 3. The metal strip 26 bridges between a pair of the pins 9 with the fingers 27 frictionally engaging the pair of pins 9 to connect them electrically. The shorting bar 25 is adapted for being positioned at a selected one of multiple positions 29, some of which are indicated by dotted lines, interconnecting electrically at least two of the pins 9 in the two rows 14, 15. Since the centerlines of the fingers 27 are 2 mm. apart, they can connect with any pair of the pins 9 on 2 mm. pitch spacings. The multiple openings 21 through the shroud allow for entry of an extraction tool 30 to remove the shorting bar 25. Each of the multiple positions 29 of the shorting bar 25 is aligned with at least one of the openings 21, such that the extraction tool 30 can enter the opening 21 and pry the shorting bar 21 away from the pair of pins 9.

Figure 9:
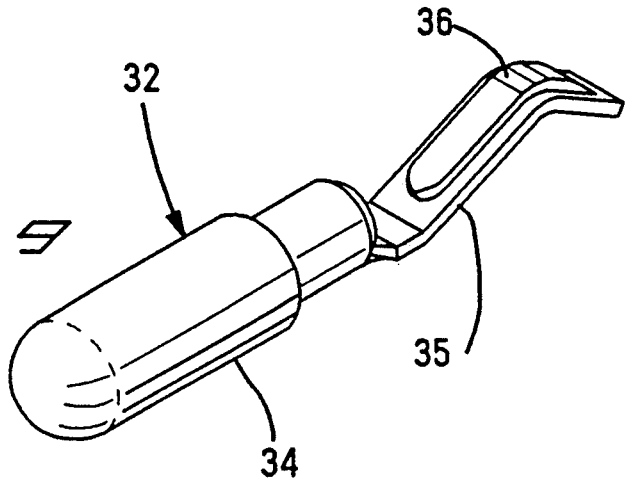
FIG. 9 is a perspective view of an electrical contact within another shroud of the connector shown in FIG. 1.
Figure 10:
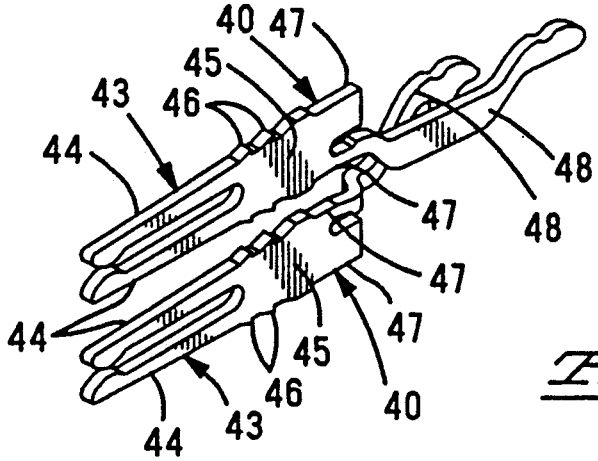
FIG. 10 is a perspective view of a pair of contacts within the unshrouded connector shown in FIG. 1.

The shroud 3 is one of multiple shrouds 3, 31 at the mating end 4 of the housing 2. The multiple shrouds 3, 31 are of different peripheral shapes and contain electrical contacts 5, 32 of different shapes. For example, the shroud 3 is rectangular and is contiguous at the mating end 4 of the connector 1 with the shroud 31 with a periphery that is rectangular with two diagonal chamfered corners 33. The contacts 32 within the shroud 31 are arranged four in a row. Each of the contacts 32, FIG. 9, is of unitary construction, stamped and formed from metal strip, having a bulbous front end 34 and a solder terminal 35 projecting from a rear of the housing 2. The solder terminal 35 is curved with a contact surface 36 for engaging one of the four solder pads 37 on the circuit board 8. For example, the contacts 32 comprise, 0.84 mm. diameter pins on 0.200 mm. pitch spacing.

The connector 1 further may be unitary with an unshrouded connector 38 with a generally D shaped periphery at the mating end 4 of the connector 1. The unshrouded connector 38 is separated by a clearance space 39 from the shroud 3. Electrical contacts 40 within the connector 38 are arranged in two rows, a top row 41, and a bottom row 42. Each of the contacts 40 is of unitary construction, stamped and formed from metal strip. Each of the contacts 40 comprises, an electrical receptacle 43 defined by an opposed pair of spring ringers 44, a middle portion 45 with barbs 46 along opposite edges 47, and solder terminals 48 projecting from a rear of the housing 2 for connection to a pad 13' in a row 16' or 17'. For example, the connector 38 can be a 68 position receptacle connector with the contacts 40 on 0.50 mm pitch spacing.

The solder terminal 48 of each contact 40 in the bottom row 42 is offset laterally from the centerline of the receptacle 43 of the same contact 40. Thereby, a solder terminal 48 of each contact 40 in the top row 41 can bend upward without engaging a solder terminal 48 of a contact 40 in the bottom row 42. The solder terminals 48 of the contacts 40 in one row are offset laterally with respect to the solder terminals 48 of the contacts 40 in the other row.

We claim:

1. An electrical connector, comprising: an insulative housing, a shroud at a mating end of the housing, multiple electrical contacts within the shroud and projecting toward the mating end, at least one shorting bar being positioned at a selected one of multiple positions in the shroud interconnecting electrically at least two of the contacts, multiple extraction tool receiving openings through the shroud, and board mounts of the housing for connection of the housing near an edge of a circuit board, while all of such openings are open to a receipt of an extraction tool to remove the shorting bar, the multiple extraction tool receiving openings being distributed about the periphery of the shroud, and every one of the multiple positions of the shorting bar being aligned with an adjacent one of the extraction tool receiving openings.

2. An electrical connector as recited in claim 1, and further comprising: the periphery of the shroud being shaped to interfit with a complementary shaped periphery of an electrical plug.

3. An electrical connector as recited in claim 1, and further comprising: at least one of the openings extending through the mating end and being shaped to interfit with a complementary shaped key of an electrical plug.

4. An electrical connector as recited in claim 1, and further comprising: the openings extending rearward from the mating end.

5. An electrical connector as recited in claim 1, and further comprising: the contacts being arranged in two rows, and the openings extending through respective walls of the shroud beside one of the rows.

6. An electrical connector as recited in claim 1, and further comprising: each of the openings extending through the mating end, and at least one of the openings being shaped to interfit with a complementary shaped key of an electrical plug.

7. An electrical connector as recited in claim 1, and further comprising: the shroud being joined integrally at the mating end with at least one of multiple other shrouds at the mating end.

* * * * *